US006474649B1

(12) United States Patent
Kennedy et al.

(10) Patent No.: US 6,474,649 B1
(45) Date of Patent: Nov. 5, 2002

(54) APPARATUS AND METHOD FOR PLAYING A CARD GAME

(75) Inventors: Julian J. Kennedy, Longs, SC (US); Bobby T. Price, Longs, SC (US)

(73) Assignee: Vegas Amusement Incorporated, Longs, SC (US)

( * ) Notice: Subject to any disclaimer, the term of this patent is extended or adjusted under 35 U.S.C. 154(b) by 0 days.

(21) Appl. No.: 09/743,064

(22) PCT Filed: Jul. 8, 1999

(86) PCT No.: PCT/ZA99/00049

§ 371 (c)(1),
(2), (4) Date: Jan. 4, 2001

(87) PCT Pub. No.: WO00/02633

PCT Pub. Date: Jan. 20, 2000

Related U.S. Application Data

(60) Provisional application No. 60/092,017, filed on Jul. 8, 1998.

(51) Int. Cl.[7] ..... A63F 1/00

(52) U.S. Cl. ..... 273/304; 273/309; 273/292; 273/308; 463/12

(58) Field of Search ..... 273/292, 303–306, 273/274, 309, 308; 463/12, 13

(56) References Cited

U.S. PATENT DOCUMENTS 5,248,142 A * 9/1993 Breeding
5,653,444 A * 8/1997 Dahl
5,876,283 A * 3/1999 Parra et al.

* cited by examiner

*Primary Examiner*—Benjamin H. Layno
(74) *Attorney, Agent, or Firm*—Jones Tullar & Cooper PC

(57) ABSTRACT

A card game using conventional deck of 52 playing cards. Unique symbols which are different from the standard markings on playing cards of the conventional 52 card deck are provided on a select number of the playing cards. Each unique symbol being provided on only one card and no card having more than one unique symbol. Each player is associated with a unique symbol. The unique symbols may be associated to a player by providing a respective unique symbol at each player station of a card game table, and each player being assigned a player station. Each player optionally places a bet upon a chance that predetermined event will occur. Cards are dealt to the players and to a dealer according to a set of rules. If a predetermined event occurs wherein one or more of the player's cards and the dealer's cards having a playing card with a unique symbol corresponding with the player's associated unique symbol, that player is paid a return amount.

29 Claims, 3 Drawing Sheets

APPARATUS AND METHOD FOR PLAYING A CARD GAME

This application claims the benefit of provisional application No. 60/092,017 filed Jul. 8, 1998.

BACKGROUND OF THE INVENTION

The present invention relates to card games. More particularly, the invention relates to improvements in card games in which players wager amounts based on the outcome of the game.

Various card games are played around the world in casinos and video gaming machines. Some of the more popular games, for example poker and blackjack, are well understood by the general public and are well entrenched with casino players. Blackjack tables, for example, are believed to provide over 75% of available game seats in casino game table areas. Thus, while many new games and many innovations to traditional games have been proposed, each of these must overcome the initial tendency of players to avoid the unfamiliar.

There have been efforts to enhance traditional wagering games by providing additional wagering and payoff opportunities. One successful example is the progressive jackpot method disclosed in the specification of U.S. Pat. No. 5,626,341, the entire disclosure of which is incorporated by reference herein for all purposes.

Many of these efforts, however, have failed to gain popularity at least in part because they require alteration or interruption of traditional game rules. Players unfamiliar with new rules are therefore unable to play the game they know without participating in the game enhancement. With other traditional options available, many of these players hesitate to invest the time to learn a new game.

SUMMARY OF INVENTION

The present invention recognizes and addresses at least some of the foregoing disadvantages, and others, of prior art construction and methods.

Accordingly, it is an object of the present invention to provide an improved wagering card game.

It is a further object of the present invention to provide a wagering card game providing an enhanced wagering opportunity.

Some of these objects are achieved by a method of playing a wagering card game having rules substantially based on the card game twenty-one. A plurality of playing cards is provided, each card having a back side and a front side, the back side including a design common to all the playing cards and the front side indicating a value of the card. A symbol is provided on at least one of the cards that distinguishes that card from other cards in the plurality of cards. The card game is played under the twenty-one rules. During play, an amount is wagered upon the chance that a participant in the card game receives a card having the symbol. When the wager is unsuccessful, at least a portion of the wagered amount is put into a progressive jackpot. When the wager is successful, a return amount is paid from the progressive jackpot.

In another embodiment of the present invention, a plurality of playing cards configured to be used in a card game is provided. A playing area is provided having a plurality of player stations. A symbol is provided at each player station that is unique from the symbol of each other player station. The unique symbols are provided on respective sets of playing cards of the plurality of playing cards, each set including at least one playing card. During play of the card game, a first amount is wagered upon the chance that a first predetermined event will occur during play. A second amount is wagered on the chance that a second predetermined event will occur during play. Upon occurrence of the first event, a first return amount is paid to a player having wagered the first amount. Upon occurrence of the second event, a second return amount is paid to a player having wagered the second amount, the second return amount being dependent at least in part upon whether a card having a symbol occurs within the event and whether one or more symbols occurring within the event match the symbol at the player station at which the player having wagered the second amount is located.

According to one aspect of the invention there is provided a method of playing a card game in which at least one player participates which includes the steps of:

(a) associating a unique symbol with each respective player;

(b) providing such symbol on at least one respective card in a plurality of cards;

(c) dealing cards to at least one player and to a dealer;

(d) playing the card game according to a set of rules;

(e) allowing at least one player to wager an amount upon a chance that at least one predetermined event will occur during the playing of the game, the predetermined event being dependent at least on the player's cards at the time; and (f) upon occurrence of the said predetermined event paying a return amount to the player who wagered the said amount, the return amount being dependent at least on whether one or more of the said player's cards and the dealer's cards, at the time, include the symbol associated with the said player.

This invention also provided apparatus by means of which at least one player can play a card game, the apparatus including at least one player station, a symbol which is uniquely associated with the player station, input means at the player station for accepting at least first and second wagers made by a player at the player station, cards which bear a plurality of symbols and which are distributed, after the wagers are made, to the player and to a dealer who receives at least one card the symbol of which is obscured, means for paying a first return to the player if the player made a successful first wager in terms of rules of the card game, and means for paying a second return to the player if the player made a successful first wager, the amount of the second return depending at least on the obscured symbol of the dealer's card.

According to a different aspect of the invention there is provided apparatus by means of which at least one player can play a card game, the apparatus including a card table with a plurality of player stations, unique symbols which are respectively associated with the player stations, a plurality of cards, at least some of the cards respectively having at least some of the symbols, and means for accumulating a progressive first level jackpot based on wagers made by at least one player, a payout from the first level jackpot, upon a successful wager by a player, being dependent in amount at least on whether one or more of the said player's cards at the time include the symbol associated with the said player's player station.

BRIEF DESCRIPTION OF THE DRAWINGS

A full and enabling disclosure of the present invention, including the best mode thereof, directed to one of ordinary skill in the art, is set forth hereinafter with reference to the appended drawings, in which.

Figure 1:
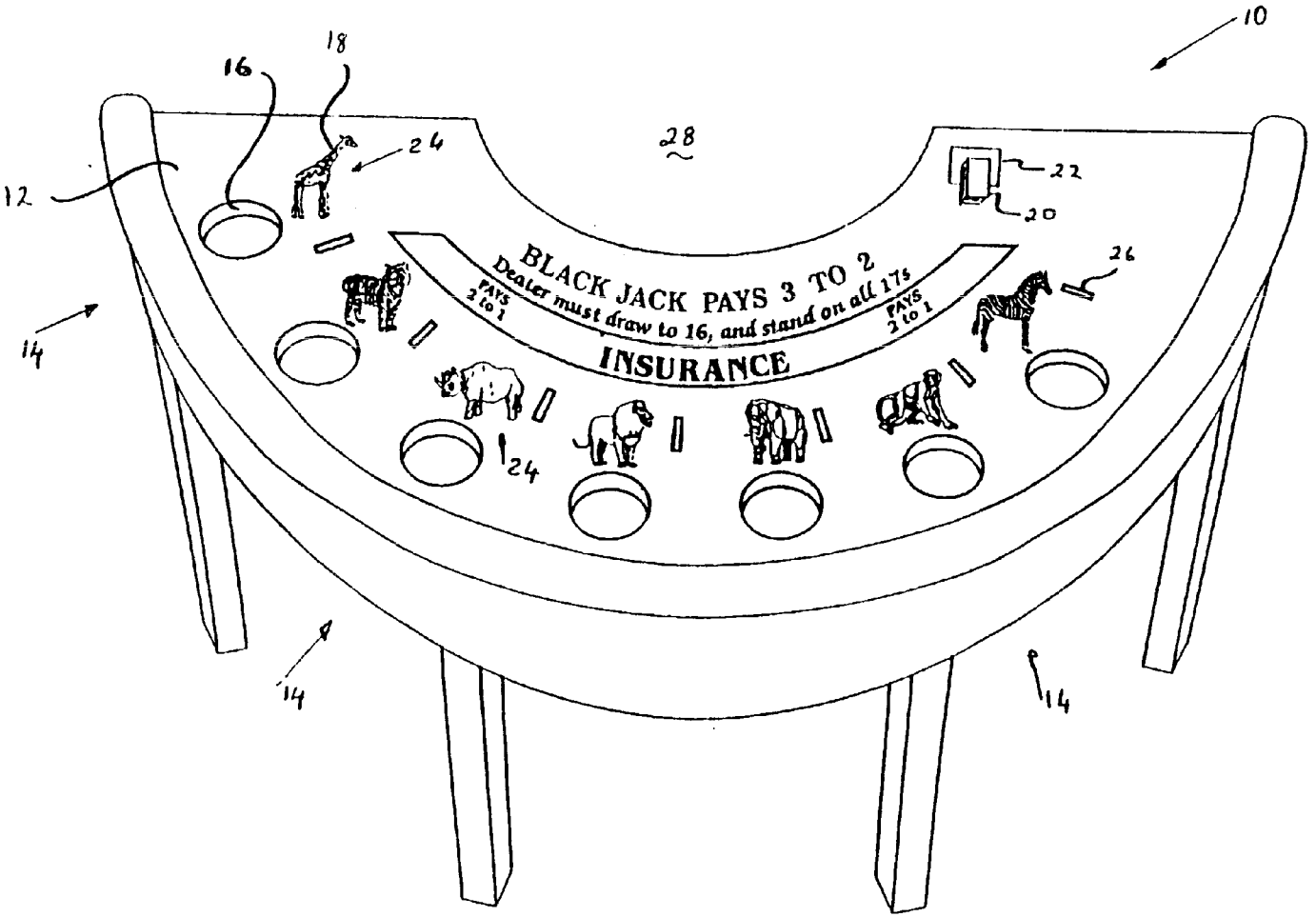
FIG. 1 is a perspective view of a card game playing area or table constructed in accordance with an embodiment of the present invention.

Repeat use of reference characters in the present specification and drawings is intended to represent the same or analogous features or elements of the invention.

DESCRIPTION OF PREFERRED EMBODIMENTS

Reference is made in detail to presently preferred embodiments of the invention, examples of which are illustrated in the accompanying drawings. Each example is provided by way of explanation, and not limitation, of the invention. It is apparent to those skilled in the art that modifications or variations can be made to the present invention without departing from the scope or spirit thereof. For instance, features illustrated as part of one embodiment may be used in another embodiment to yield a further embodiment. Thus it is intended that the present invention covers such modifications and variations.

The present invention is discussed primarily through the example of a blackjack game also known as twenty-one. It should be understood by those skilled in this art, however, that the principles of the invention may be employed with other suitable card games. Accordingly, the blackjack example is provided for illustrative purposes only and is not intended to limit the scope or spirit of the present invention.

A table 10 for playing a blackjack game pursuant to the present invention is illustrated in FIG. 1. The table 10 includes a playing area 12 having seven player stations 14 at which respective players are seated. The table may be of any suitable construction, for example including cup holders 16 disposed at each player station.

As illustrated in FIG. 1, a symbol 18 is provided at each player station and is uniquely associated with such station. The symbols in the illustrated embodiment are animal characters 18, but it should be understood that any suitable symbols could be used. A plurality of playing cards 20 are disposed in a shoe 22 for dealing by a dealer as is known in this art. Each animal character 18 is used as a first betting slot 24 at its respective player station. A second betting slot 26 is also provided for making wagers during game play. A dealer stands or sits in a dealer bay 28, dealing cards from the shoe 22 and collects and pays money or tokens into, or pays money or tokens out of, a bank (not shown).

Figure 2:
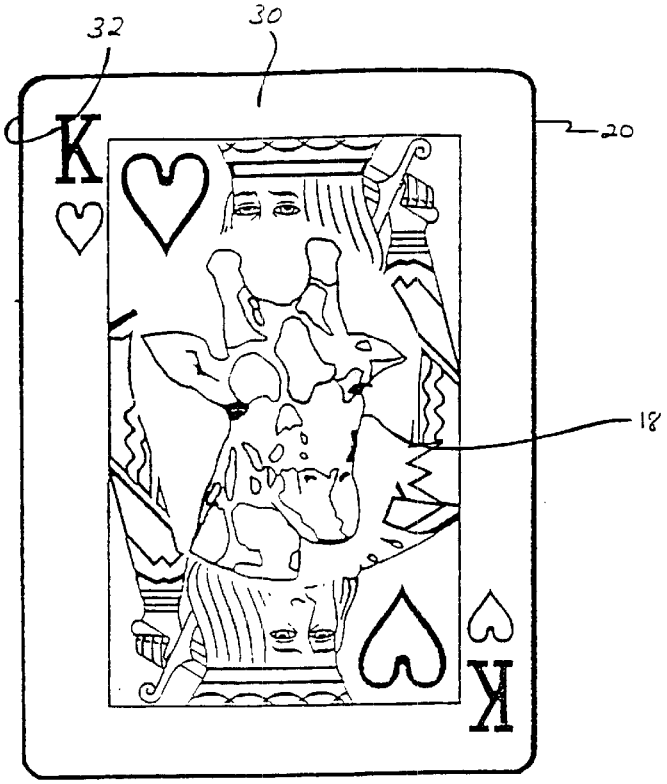
FIG. 2 shows a playing card having a symbol thereon for use in a card game played in accordance with an embodiment of the present invention.

FIG. 2 illustrates a card 20 having an animal character 18 printed on a front or value side 30 of the card. It is also possible to print the animal character on a back side 32 on which is printed a pattern common to all the cards 20 within the shoe 22 (FIG. 1).

A plurality of standard fifty two card playing decks are housed in the card shoe for use during a blackjack game. In this embodiment, eight standard decks are used, although it should be understood that other suitable arrangements may be employed.

Within these combined eight decks, there are seven sets of thirteen cards, the cards of each set having respective animal characters thereon. It should be understood that more or fewer than thirteen cards may be included in each set as desirable for a particular game, and that the number of sets may be varied.

As there are eight decks, there are eight sets of each of the four standard card suits, spades, hearts, diamonds and clubs. Each animal character 18 illustrated in FIG. 1 is printed on the value side of each card in each respective aforementioned thirteen-card set of the same suit. Thus, a giraffe as shown in FIG. 2 is printed on the value side of each card in one set of hearts, including the two, three, four, five, six, seven, eight, nine, ten, jack, queen, king and ace. The value or front side of the king of hearts so printed is illustrated in FIG. 2. A respective set of hearts within the shoe 22 (FIG. 1) is printed with each of the animal characters shown in FIG. 1.

Figure 3:
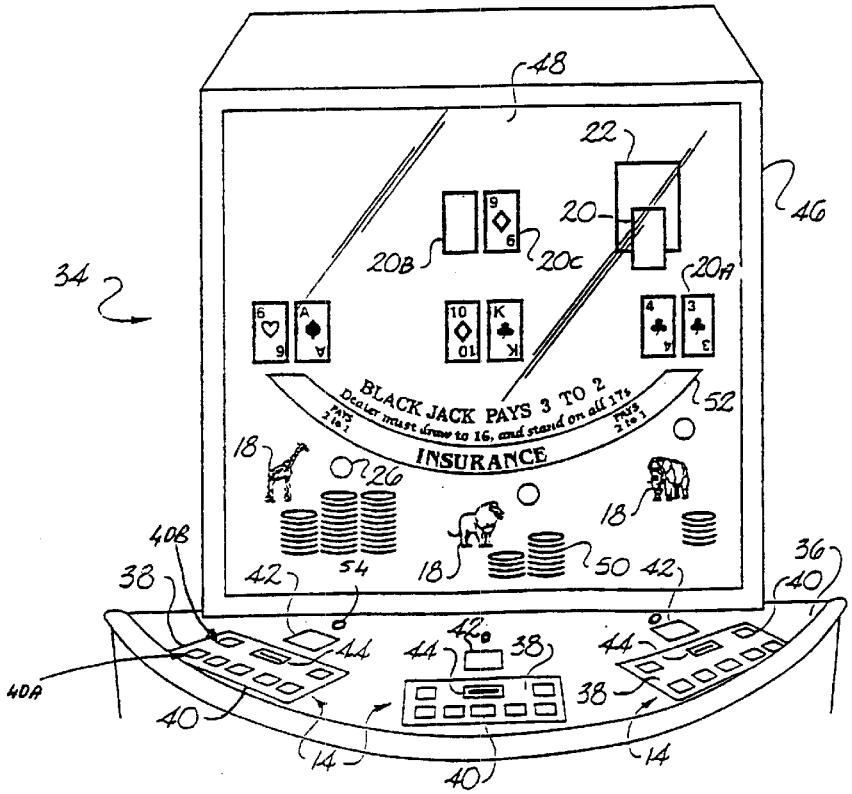
FIG. 3 is a schematic view of a video gaming machine constructed in accordance with an embodiment of the present invention.

An embodiment of the present invention formed as a video gaming machine 34 is illustrated in FIG. 3. The video gaming machine 34 includes a tabletop 36 having three player stations 14. Each station has a button panel or keypad 38 including a plurality of buttons 40 through which players participate in the blackjack game. A currency acceptor 42 is configured to receive bills of various denominations. The currency acceptor could also accept coins. Multi-player interactive video gaming devices which may be used in accordance with this invention are disclosed in the specifications of U.S. patent applications Ser. Nos. 08/885,276 and 08/903,086 the disclosures of which are incorporated by reference herein for all purposes.

Each button panel 38 includes a first row of five input buttons 40A and a second row of two input buttons 40B. The use, number and arrangement of such buttons depends upon the nature of the video gaming program operated within the present invention. For example, a blackjack game may require the use of one set of keys while a poker game may call for different keys. The currency acceptor 42 accepts bills for betting or game fee purposes. A ticket dispenser 44 is mounted at each player station. Any player may "cash out" at any time by inputting a proper command at the respective player station. A printer mounted within the cabinet then prints a redeemable ticket, indicating the player's winnings, via the ticket dispenser 44.

A video display 46 includes a screen 48 on which is displayed for each player station a respective animal character 18, an image 26 of a second betting slot and a coin display 50 representing tokens, credits, or winnings credited to a player at any given time. The card shoe 22 and the cards 20 of the unplayed deck are illustrated at an upper end of the screen 48. Cards 20 A dealt to each player are displayed above a bar 52. The dealer is dealt a down card 20B and an up card 20C.

Figure 4:
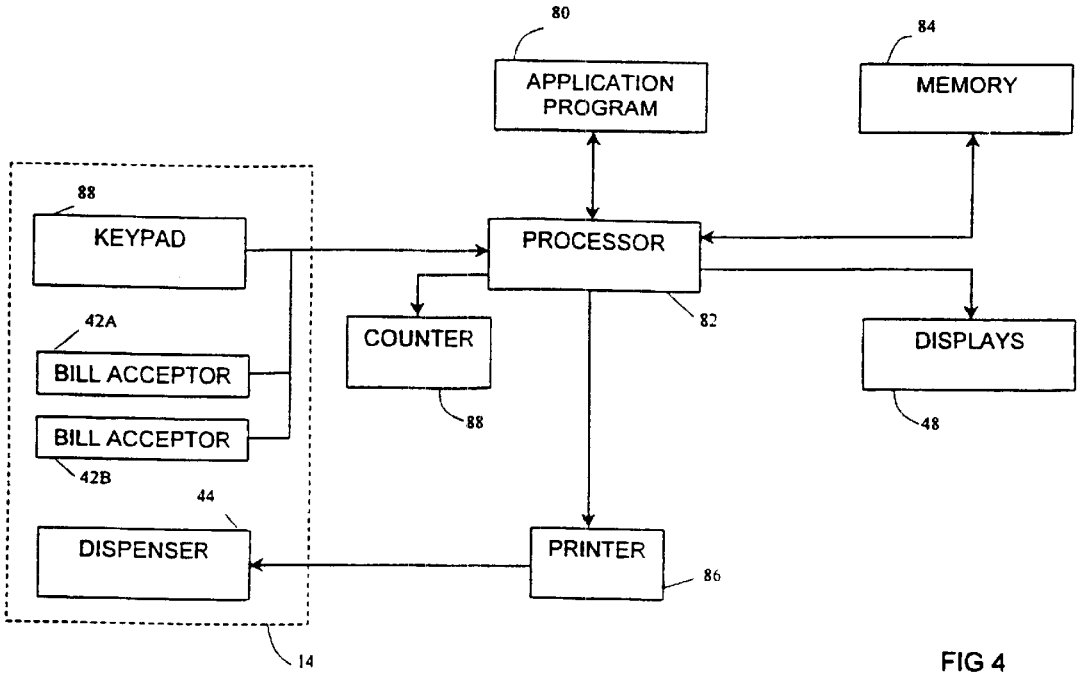
FIG. 4 is a block diagram representation of equipment which forms part of the video gaming machine.

FIG. 4 diagrammatically depicts components of the aforementioned arrangement. The playing of the game is under the control of an application program which is held in a memory 80 and which is executed by a processor 82. Data on game events is stored in, and accessed from, a memory 84. Input data from a key pad 88, at any player station 14, is directed to the processor 82 which also accepts data from the respective bill acceptor 42. The processor can output hard copy data via a printer 86 to each respective dispenser 44, and display data to the various symbols or images 10, 20, 50 and 52 etc. on the display screen 48. Counts of currency accepted for blackjack bets, and side bets for a progressive jackpot, where applicable, are kept in one or more meters 88 which are actuated by the processor 82.

Operation of an exemplary version of a blackjack game according to the present invention is discussed with reference to FIGS. 1 and 3. It is to be understood that when a player "places" a bet at a character 18, which acts as a first betting slot, or a second betting slot 26, the player may do so manually at the table 10 or electronically through the buttons 40 at the game machine 34. Accordingly, it should be understood that actions which are taken during the game, as described herein, may be made manually or electronically and that, for purposes of clarity, this distinction is not made at each point in the following discussion.

In the present blackjack embodiment, any of the many variations of the twenty-one game may be used. For example, in some versions the dealer wins a tie, while in others a tie results in a "push". In others, even where ties push, the dealer wins if his first two cards add to twenty-one and a player's cards do not, without giving the player the opportunity to take additional cards in an attempt to achieve twenty-one. Although the particular version of the twenty-one game may vary, all such games are based on the player's attempt to achieve a score closer to twenty-one than the dealer, without going over. Accordingly, while in one preferred embodiment ties push, and the dealer wins with an initial twenty-one where the player has less than twenty-one, it should be understood that any suitable blackjack variation may be employed.

In the present embodiment, players at the respective player stations 14 have the opportunity to wager on two general events. A first event is a conventional event in a basic twenty-one game, that is that the player will achieve a score closer to twenty-one than the dealer, without going over a score of twenty-one. The player also has an option to wager on a second event, which in this embodiment is that the player will achieve a blackjack (a score of twenty-one on his first two cards) and that the dealer will have a down card. Since in most blackjack games the dealer is always dealt a down card, the player blackjack is a first variable within the event, but the nature of the down card is a second variable.

A return amount is paid to the player from the bank upon occurrence of the first event according to the rules of the blackjack game, for example one-to-one for a non-blackjack win and three-to-two for a blackjack win. A second event return amount may be paid from the bank or from a jackpot such as a progressive jackpot as disclosed in the specification U.S. Pat. No. 5,626,341. As discussed hereinafter, the value of the second event return amount may be determined by variables within the second event. The following discussion is directed to an exemplary system for use in conjunction with a progressive jackpot.

To begin, players place a blackjack wager at the respective animal characters 18 and, optionally, a side bet at the respective second slots 26. Where all payouts on the side bet are a fixed predetermined amount, they may optionally be paid from the bank. In the present embodiment, however, second event payouts are made from a progressive jackpot which may include a progressive jackpot apparatus, such as described in the specification of U.S. Pat. No. 5,626,341, in which the second betting slot 26 is a coin or bill acceptor.

In a live table version, as indicated in FIG. 1, the slot 26 for the side bet currency acceptor is located beside the player station's animal character 18. Thus, a player places tokens on the animal character to make blackjack wagers and places bills or coins into the respective slot 26 to make side bets. In the video or electronic version, two currency acceptors (42A, 42B) may be used at each player station, one for the blackjack wager and one for the side bet. Alteratively, a single currency acceptor may be used at each player station, with the game program prompting the player to place blackjack wagers and side bets at different times, so that the blackjack wagers and side bets may be distinguished from each other. The amounts of these wagers are indicated on the video display 46 as coin or token images stacked on or proximate the player's animal character, for the blackjack bet, and at a betting slot image 26 (FIG. 3), for the side bet.

To place a side bet, a player places a gaming token, coin or bill into the acceptor 42 associated with that player's player station 14. The currency acceptor recognises that a gaming token has been placed therein and an indicator signal, preferably a light 54 adjacent the currency acceptor or on the video screen, is activated showing that the particular player is participating in the progressive jackpot component of the game during play of that hand. The currency acceptor also sends an electronic signal to a main control board in the processor 82 which sends a signal to an odometer-type counter or meter 88 corresponding to the particular player station 14 to keep a sequential count of the number of gaming tokens or credits that are received by the currency acceptor. The main control board also activates a progressive jackpot control box which in turn controls a progressive jackpot meter or counter 88. Each gaming token or credit received by a side bet currency acceptor results in the amount shown on the progressive jackpot meter being increased by a predetermined amount. If, for example, each gaming token has a value of $1.00, then the amount shown on the progressive jackpot meter is increased by any amount of up to $1.00 for each gaming token placed into a currency acceptor. In one preferred embodiment, the progressive jackpot would be increased by between 93% to 97% of the amount of each gaming token being wagered, the balance representing the house's share of the amount wagered for providing the progressive jackpot component of the game.

When each player has had a reasonable opportunity to make a progressive jackpot wager, the dealer (whether human or electronic) activates a lockout switch which deactivates each side bet currency acceptor so that any tokens placed in a side bet currency acceptor after the lockout switch is activated will not register. This prevents late wagering after the cards are dealt. The amount shown on the progressive jackpot meter continues to increase for each gaming token wagered until a second event as noted hereinbefore occurs for one or more players. The amount a player wins from a jackpot may depend upon variables within the second event as described hereinafter.

Once bets have been made, the dealer (either human or electronic) deals cards around the table to all participants, including players and the dealer. Each player receives two up cards 20A. The dealer first receives a down card 20B and then an up card 20C. The game proceeds according to the particular blackjack rules at the table, and a return amount is paid to any player having made a successful blackjack wager at his animal character 18. When the game is completed, a return amount is paid to each player who received a blackjack and who made a side bet. The amount of this return depends upon the player's two blackjack cards and upon the dealer's down card, the value side of which is revealed only at the blackjack game's conclusion. Thus, a player having made a side bet and having received a blackjack knows that the second event has occurred but does not know the payout amount until the dealer's down card is revealed. This maintains a player's interest in the game after he initially receives the blackjack and while other players are concluding their hands.

The second event return depends upon the player's blackjack cards and the dealer's down card. A player's blackjack hand includes one of the following combinations with the term a "special" card being used to designate a card with an animal character printed on its front side. The cards which have been dealt may be categorised, for each player as follows:

Double Matching Special Cards: Cards have matching animal characters that also match the animal character at the player's station.

Matching Special Cards: Cards have matching animal characters that do not match the animal character at the player's station.

Non-Matching Special Cards: Cards have non-matching animal characters.

Any Other: Any other combination of cards.

There are three possibilities for the dealer's down card:

Generic: Not a special card.

Special: A special card, but the character does not match the animal character at the player's station.

Matching: A special card, and the animal character matches the animal character at the player's station. An exemplary payout schedule for occurrence of the second event is as follows:

| | Dealer's Down Card | | |
|---|---|---|---|
| Player's Blackjack Cards | Generic | Special | Matching |
| Double Matching Special Cards | $1,000 | $5,000 | Jackpot |
| Matching Special Cards | $100 | $500 | $5,000 |
| Non-Matching Special Cards | $10 | $50 | $500 |
| Any Other | $1 | $5 | $50 |

It is apparent that the amount which can be won with a side bet is based on a blackjack win and on whether special cards are involved, with the dealer's down card playing a decisive role. In one sense, in this example, the player's blackjack cards and the dealers down card emulate a slot machine-like feature in that a jackpot is paid for three cards with symbols which match each other and the player's symbol. Lesser amounts are paid from the progressive accumulator as the degree of matching decreases. It follows that the amount of a payout is dependent, inter alia, on the position of, or symbol which is associated with, a player.

Further the dealer's down card has a multiplier effect the extent of which varies according to the degree of "matching" thereof with the symbols of the player's cards and with the symbol of the player's player station.

It should be understood that variations can be made to the game which has been described. For example, return payments from the side bets may be made from individual jackpots at each player station or may be made according to a fixed payback schedule from the bank. Further, there may be many variations in which a return payment is based at least in part on a player's position and/or a dealer's down card upon occurrence of a second event during play of a suitable wagering game. Various suitable sets of cards within the single or multiple decks may have symbols upon which the payback schedule is based. There may be more symbols than players, and the number of cards included within the symbol sets may vary, so that the payback rates may be scaled for individual symbols.

In other words the unique symbols which appear on the game table and which are associated with the respective player stations may appear in various frequencies or arrangements on a chosen number of the cards which are used in the card game. The combination of the symbols on the table and the symbols on the cards, taken with the variables which arise during the play of the card game and, where applicable, with the symbols of at least one of the dealer's cards, facilitate the creation of a progressive jackpot in an uncomplicated manner, the winning of which is statistically rare. The degree of matching of the symbols is a determining factor in the payout of a progressive jackpot to a particular player. The dealer's down card, which is also referred to as a hole or bonus card, clearly has a multiplier effect on the payout of a successful side bet, as is reflected in the preceding exemplary payout schedule, and the turning over of this card can be a suspense filled movement. In this schedule, which applies to the jackpot prevailing at a single common playing area, i.e. a single game table, portions ($1000 and $5000) of the accumulated jackpot are paid out for a dealer's generic card, and a dealers special card, respectively. The full jackpot at the table is paid out for a matching dealer's down card.

It falls within the scope of the invention however to use the dealer's down or hole card to link two or three jackpots, which are otherwise independent of each other, together so that a payout event at a first table may, depending on the hole card, result in the payment of the jackpot which is associated with the first table or the jackpots which are associated with two or more tables. In the latter case the tables may be in a common playing area, or the tables may be geographically displaced, and data between the tables may be transferred via a suitable network.

A feature of this modification is that, through the linking of events at different tables which give rise to payouts, a greater number of payouts takes place. This should heighten player enjoyment and increase player participation.

Figure 5:
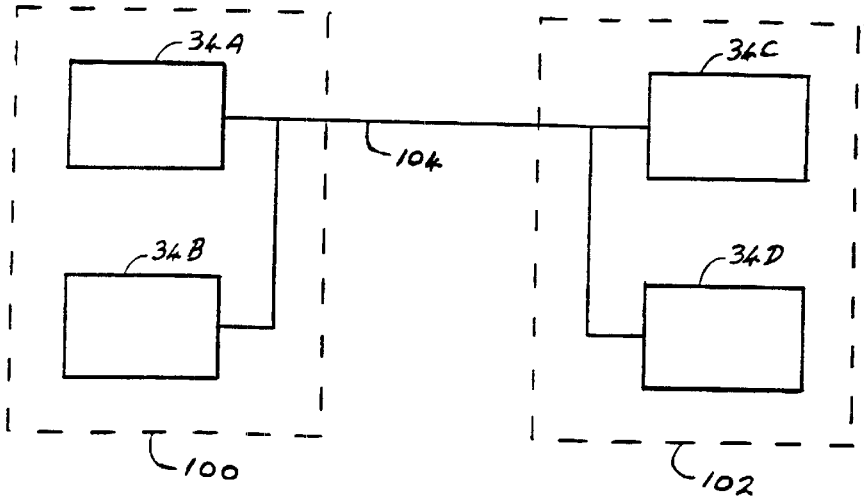
FIG. 5 illustrates a gaming arrangement wherein payouts at individual gaming tables can be made from a number of independent progressive jackpots or pools.

FIG. 5 diagrammatically illustrates these concepts. Video gaming or playing tables 34A and 34B are shown at a first location 100, and similar tables 34C and 34D are shown at a second location 102 which is geographically displaced from the location 100. The expression "geographically displaced" means for example that one location is not visible from the other location but more specifically means that the locations are spaced apart by a significant distance, which may be of the order of hundreds or thousands of kilometers. The locations are linked by communication lines 104 which may form part of a network. This may be a local area network, or wide area network such as the Internet.

Assume that play is taking place, on similar card games, independently at each of the tables. Consequently at each table a respective progressive jackpot is independently accumulated, or paid out in whole or in part, generally in the manner which has been described hereinbefore.

The dealer's hole card, at each respective table, controls:

(1) relatively frequent payouts at the table based on the jackpot accumulated at that table ie. "the table pool" or "a first level jackpot";

(2) less frequent payouts at the table based on the accumulation of the first level jackpots accumulated at the tables at the respective locations (100 or 102) ie. "the local pool" or "a second level jackpot"; and (3) rare payouts at the table based on the accumulation of the first or second level jackpots, as the case may be, accumulated at the tables at both locations, ie. "the wide area pool" or "a third level jackpot".

The second level jackpot and the third level jackpot are determined by accumulating or adding at least part of the relevant first level jackpots using, for example, the processor 82 (see FIG. 4) at one, or more, of the tables.

A typical payout schedule at a table, referring to the dealer's hole card at the table, for a networked arrangement of the type shown in FIG. 5 is:

| | Dealer's Hole Card (Bonus or Down Card) | | |
|---|---|---|---|
| Player's Cards | Any Card | Any Animal | Player's Animal |
| Blackjack Player's 2 Animals and table | Table Pool or first level jackpot | Local Pool or second level jackpot | Wide Area or third level jackpot |
| Blackjack Matching Animals | $1000 | $2500 | $5000 |
| Blackjack any 2 Animals | $250 | $500 | $1000 |
| Blackjack 1 Animal | $25 | $50 | $100 |
| Any Blackjack | $2 | $5 | $50 |

In a single player video gaming machine operating a game employing playing cards, the return payback on the side bet may be based upon the occurrence of cards having symbols or whether any such cards have matching symbols. For example, a player may make a side bet in a five card draw video poker hand in which payment on the side bet is made from a progressive jackpot and is based upon the number of cards in the player's hand having one of a given number of symbols and upon whether the symbols on these cards match. In a single player blackjack video game, a player may make a side bet that pays when the player receives a blackjack, the amount being dependent upon whether the blackjack cards have symbols and upon whether those symbols match each other and a symbol on the dealer's down card.

While one or more preferred embodiments of the invention have already been described, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore it is contemplated that any and all such embodiments are included in the present invention.

What is claimed is:

1. A method of playing a wagering card game, said method including the steps of:

(a) providing at least one deck of 52 playing cards with standard markings configured to be used in said game;

(b) providing a playing area having at least one player station;

(c) providing a respective unique symbol at each player station, each unique symbol differing from the standard markings on the cards;

(d) providing the unique symbols on respective cards of said plurality of playing cards, with each unique symbol being provided only on one card and no card having more than one unique symbol;

(e) causing said card game to be played;

(f) allowing a player to wager a first amount upon a chance that a first predetermined event will occur during said playing step (e); and (g) paying, upon occurrence of said first event, a first return amount to said player having wagered said first amount, said first return amount being dependent at least in part upon whether a said card having a said symbol occurs within said first event.

2. A method according to claim 1 wherein said playing area has a plurality of said player stations and a respective unique symbol is provided at each said player station, each symbol being uniquely associated with the respective player station, and wherein each said symbol is provided on at least one of said playing cards.

3. A method according to claim 1 wherein, in step (g) said first return amount is additionally dependent, at least in part, on whether said symbol occurring within said first event matches said symbol at said player station at which said player having wagered said first amount is located.

4. A method according to claim 3 wherein said playing area has a dealer station and wherein said first event includes the occurrence of said symbol on a dealer's card.

5. A method according to claim 3 wherein said first event includes the occurrence of said symbol on a card of said player.

6. A method of playing a wagering card game having rules substantially based on the card game twenty-one, said method including the steps of:

(a) providing at least one deck of 52 playing cards with standard markings configured to be used in the card game twenty-one;

(b) providing at least one unique symbol on at least one of said cards, which unique symbol is different from the standard markings on the cards;

(c) causing said card game to be played;

(d) allowing wagering, in relation to said playing step, of a first amount upon an occurrence in said card game of said card having said unique symbol;

(e) allocating at least a portion of said first amount into a progressive jackpot when a wager placed at said wagering step is unsuccessful; and (f) paying a return amount from said progressive jackpot to a player when a wager placed by said player at said wagering step is successful.

7. A method according to claim 6 which includes the steps of:

(g) providing a playing area having a plurality of player stations; and (h) associating a respective unique symbol with each respective player station.

8. A method according to claim 7 wherein in step (f) said return amount is dependent at least in part upon whether a card, with a unique symbol, is allocated to a player at a player station with which the same unique symbol is associated.

9. A method according to claim 7 wherein a dealer receives a card face down in said card game and wherein said return amount in step (f) is dependent at least in part upon whether said dealer down card has a unique symbol.

10. A method according to claim 9 wherein said return amount in step (f) is additionally dependent on whether said dealer down card has a unique symbol which is the same as the unique symbol associated with the respective player's player station.

11. A method of playing a card game in which at least one player participates which includes the steps of:

(a) associating a unique symbol with each respective player;

(b) providing at least one standard deck of 52 playing cards with standard markings;

(c) providing the unique symbol on at least one card in the deck of cards;

(d) dealing cards from the deck to at least one player and to a dealer;

(e) playing the card game according to a set of rules;

(f) allowing at least one player to wager an amount upon a chance that at least one predetermined event will occur during the playing of the game, the predetermined event being dependent at least on the player's cards at the time; and (g) upon occurrence of said predetermined event paying a return amount to the player who wagered said amount, the return amount being dependent at least on whether one or more of the player's cards and the dealer's cards, at the time, include the unique symbol associated with the player.

12. A method according to claim 11 in which a plurality of players participate at a common playing table, which includes the step of:

(h) accumulating a first level jackpot from wagers made by players in terms of step (f); and wherein said return amount in step (g) is dependent at least on the amount of the accumulated first level jackpot.

13. A method according to claim 12 in which at least two groups of players participate at respective common playing tables, each group of players including a respective plurality of players and which includes the step of:

(i) accumulating a second level jackpot from the respective first level jackpots at each of said common playing tables; and wherein said return amount in step (g) is dependent at least on the amount of the accumulated second level jackpot.

14. A method according to claim 13 wherein the respective common playing tables for the at least two groups of players are geographically displaced from each other.

15. A method according to claim 13 for at least three groups of players which participate at respective common playing tables, each group of players including a respective plurality of players, and wherein (k) the common playing tables for at least two of said groups of players are at a first location;

(l) the common playing table for at least a third said group of players is at a second location which is geographically displaced from the first location;

(m) the first location is electronically linked to the second location;

(n) a third level jackpot is accumulated from at least the second level jackpot at the first location and the first level jackpot at the second location; and (o) wherein said return amount in step (i) is dependent at least on the amount of the accumulated third level jackpot.

16. A method of playing a wagering card game which includes the steps of:

(a) providing a playing area with a plurality of player stations;

(b) providing a plurality of unique symbols, each unique symbol being uniquely associated with a respective player station;

(c) providing at least one standard deck of 52 playing cards with standard markings;

(d) providing the unique symbols on some of the cards, each unique symbol being provided only on one card and no card having more than one unique symbol;

(e) causing said card game to be played using the cards;

(f) allowing each player to wager upon a chance that a predetermined event will occur during step (e); and (g) upon occurrence of said predetermined event paying an amount to the respective player, which amount is dependent on whether, at the time, a card which is associated with a player has the unique symbol which is uniquely associated with said player's player station.

17. Apparatus for playing a card game which includes:

(a) a playing area;

(b) a plurality of player stations, for respective players, in the playing area;

(c) a plurality of unique symbols, each symbol being uniquely associated with a respective player station; at least one standard deck of 52 playing card with standard markings, each said unique symbol being additionally provided on at least one of said cards and wherein each unique symbol is provided only on one card and no card has more than one unique symbol;

(e) means for accepting a wager from each respective player upon a chance that a predetermined event will occur during playing of the card game; and (f) means for paying an amount, to the respective player, upon occurrence of said predetermined event, which amount is dependent at least on whether, at the time, a card which is associated with a player has said symbol which is uniquely associated with said player's player station.

18. Apparatus by means of which at least one player can play a card game, the apparatus including at least one player station, a unique symbol which is uniquely associated with the player station, input means at the player station for accepting at least a first wager made by a player at the player station, at least one standard deck of 52 playing cards with standard markings, one of the cards additionally having the unique symbol, the cards being distributed, after the wager is made, at least to the player and to a dealer who receives at least one card face down, means for paying a first return to the player if the player made a successful first wager in terms of rules of the card game, and means for paying a second return to the player if the player made a successful first wager, the amount of the second return depending at least on whether the dealer's face down card has the unique symbol.

19. Apparatus by means of which at least one player can play a card game, the apparatus including a card table with a plurality of player stations, unique symbols which are respectively associated with the player stations, at least one standard deck of 52 cards with standard markings, and at least some of the cards respectively additionally having at least some of the unique symbols, a payout, upon a successful wager by a player, being dependent in amount at least on whether one or more of said player's cards at the time include the unique symbol associated with said player's player station.

20. Apparatus according to claim 19 which includes means for accumulating a progressive first level jackpot based on wagers made by at least one player and wherein said payout is made from said first level jackpot.

21. Apparatus according to claim 20 wherein the card table includes a dealer's station and wherein said payout is dependent in amount on whether one or more of said dealer's cards at the time include the symbol associated with the player's player station.

22. A gaming arrangement which includes at least a first apparatus and a second apparatus, each apparatus being according to claim 21, the first apparatus accumulating a first first level jackpot and the second apparatus accumulating a second first level jackpot, means to accumulate at least part of the first first level jackpot and at least part of the second first level jackpot to produce a second level jackpot, a payout of which, upon a successful wager by a player at the first apparatus or at the second apparatus, as the case may be, being dependent in amount on whether, at the time, one or more of the cards of the dealer at the first apparatus or the second apparatus include the symbol associated with said player's player station.

23. Apparatus according to claim 19 wherein the card table includes a dealer's station and wherein said payout is dependent in amount on whether one or more of said dealer's cards at the time include the symbol associated with the player's player station.

24. A gaming arrangement which includes at least a first apparatus and a second apparatus, each apparatus being according to claim 23, the first apparatus accumulating a first first level jackpot and the second apparatus accumulating a second first level jackpot, means to accumulate at least part of the first first level jackpot and at least part of the second first level jackpot to produce a second level jackpot, a payout of which, upon a successful wager by a player at the first apparatus or at the second apparatus, as the case may be, being dependent in amount on whether, at the time, one or more of the cards of the dealer at the first apparatus or the second apparatus include the symbol associated with said player's player station.

25. A method of playing a wagering card game which includes the steps of;

(a) providing at least one deck of 52 playing cards with standard markings;

(b) providing at least one unique symbol on at least one card, the unique symbol being additional to the respective standard marking on the card;

(c) providing a playing area with a dealer station and at least one player station;

(d) providing the unique symbol at the player station;

(e) playing the card game, and (f) utilizing the unique symbol as a determining factor in an outcome of the game.

26. A method according to claim 25 wherein the unique symbol is utilized as a determining factor in the payout of a progressive jackpot associated with the card game.

27. A method according to claim 25 wherein the card game is played in conjunction with a dealer and wherein step (f) is implemented when the unique symbol is on a dealer's card.

28. A method according to claim 25 wherein the card game is played by at least one player in conjunction with a dealer and wherein step (f) is implemented when the unique symbol is on a player's card.

29. A gaming arrangement which includes a playing area with a dealer station and the plurality of player stations, at least one card deck which includes 52 playing cards divided into 4 standard 13 card sets of spades, diamonds, hearts and clubs respectively, each card including a value side and a back side, a plurality of the cards having respective unique symbols on their value sides, each unique symbol being provided only on one card and no card having more than one unique symbol, and each player station having a unique symbol applied to it, each unique symbol being applied to only one player station and no player station having more than one unique symbol.

* * * * *